US008336629B2

(12) United States Patent
Vaynshteyn et al.

(10) Patent No.: US 8,336,629 B2
(45) Date of Patent: Dec. 25, 2012

(54) METHOD AND SYSTEM FOR RUNNING SUBSEA TEST TREE AND CONTROL SYSTEM WITHOUT CONVENTIONAL UMBILICAL

(75) Inventors: Vladimir Vaynshteyn, Sugar Land, TX (US); Joseph D. Scranton, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 435 days.

(21) Appl. No.: 12/572,508

(22) Filed: Oct. 2, 2009

(65) Prior Publication Data

US 2011/0079395 A1 Apr. 7, 2011

(51) Int. Cl.
*E21B 34/04* (2006.01)

(52) U.S. Cl. ..... 166/345; 166/344; 166/352; 166/368; 166/375

(58) Field of Classification Search ..... 166/345, 166/338, 344, 347, 351, 352, 367, 368, 373–375, 166/381, 386
See application file for complete search history.

(56) References Cited

U.S. PATENT DOCUMENTS

| | | | | |
|---|---|---|---|---|
| 3,894,560 | A * | 7/1975 | Baugh | 137/606 |
| 4,658,904 | A | 4/1987 | Doremus et al. | |
| 6,102,124 | A * | 8/2000 | Skeels et al. | 166/347 |
| 6,142,236 | A * | 11/2000 | Brammer et al. | 166/358 |
| 6,293,344 | B1 * | 9/2001 | Nixon et al. | 166/363 |
| 6,330,913 | B1 | 12/2001 | Langseth et al. | |
| 6,343,654 | B1 * | 2/2002 | Brammer | 166/338 |
| 6,357,525 | B1 | 3/2002 | Langseth et al. | |
| 6,484,806 | B2 * | 11/2002 | Childers et al. | 166/351 |
| 6,880,640 | B2 * | 4/2005 | Barratt et al. | 166/346 |
| 6,942,028 | B2 * | 9/2005 | Hosie | 166/88.4 |
| 7,013,970 | B2 * | 3/2006 | Collie et al. | 166/89.1 |
| 7,086,467 | B2 | 8/2006 | Schlegelmilch et al. | |
| 7,225,873 | B2 | 6/2007 | Schlegelmilch et al. | |
| 7,318,480 | B2 * | 1/2008 | Hosie et al. | 166/367 |
| 7,331,396 | B2 * | 2/2008 | Reimert et al. | 166/368 |
| 7,395,866 | B2 * | 7/2008 | Milberger et al. | 166/345 |
| 7,513,308 | B2 * | 4/2009 | Hosie et al. | 166/338 |
| 7,628,207 | B2 | 12/2009 | Leonardi et al. | |
| 7,650,943 | B2 * | 1/2010 | Baggs | 166/341 |
| 7,891,429 | B2 * | 2/2011 | Boyce et al. | 166/340 |
| 7,921,919 | B2 * | 4/2011 | Horton, III | 166/366 |
| 7,934,560 | B2 * | 5/2011 | Roveri et al. | 166/345 |
| 2005/0217845 | A1 * | 10/2005 | McGuire | 166/100 |
| 2006/0254773 | A1 | 11/2006 | Schlegelmilch et al. | |
| 2007/0044972 | A1 * | 3/2007 | Roveri et al. | 166/367 |
| 2007/0204998 | A1 | 9/2007 | Rytlewski | |
| 2008/0105436 | A1 | 5/2008 | Molina et al. | |
| 2008/0110633 | A1 * | 5/2008 | Trewhella | 166/336 |

(Continued)

FOREIGN PATENT DOCUMENTS

WO 0001915 A2 1/2000

*Primary Examiner* — Matthew Buck
(74) *Attorney, Agent, or Firm* — Chad Sullivan; Rodney Warfford; Matt Abrell

(57) ABSTRACT

A technique enables a simplified approach for providing subsea hydraulic control. A subsea installation comprises one or more devices that are actuated hydraulically. A simple signal carrier, such as a wireline logging cable, can be routed down to the subsea installation. However, hydraulic fluid for controlling the one or more hydraulic devices in the subsea installation is delivered via an open water umbilical that extends to the subsea installation from a separate workover control system.

17 Claims, 2 Drawing Sheets

U.S. PATENT DOCUMENTS

2008/0202761 A1* 8/2008 Trewhella ..... 166/351
2009/0229830 A1 9/2009 Kerr
2009/0260829 A1 10/2009 Mathis
2010/0012327 A1 1/2010 Leonardi et al.
2010/0071907 A1 3/2010 Leonardi et al.
2010/0276155 A1 11/2010 Niemeyer et al.
2011/0297387 A1* 12/2011 Hart ..... 166/345

* cited by examiner

METHOD AND SYSTEM FOR RUNNING SUBSEA TEST TREE AND CONTROL SYSTEM WITHOUT CONVENTIONAL UMBILICAL

BACKGROUND

In a variety of subsea well related applications, hydraulically operated intervention equipment is deployed at the seabed or at other subsea locations. The hydraulically operated equipment requires a relatively large sized multi-hose hydraulic control umbilical with each hydraulic hose in the umbilical designated to control a unique equipment function. For example, two hoses in a hydraulic umbilical can be designated for opening and closing a valve in a subsea test tree. The technique requires the use of a bespoke umbilical and associated spooling/handling equipment able to deploy the umbilical into a drilling riser and down to the subsea equipment. The umbilical is routed down through the drilling riser and coupled to hydraulic porting in a tubing hanger running tool.

In one variation, an electro-hydraulic multiplex control system can be employed to facilitate control of the subsea equipment with fewer hydraulic hoses running from the surface. This type of control system can be operated to redirect hydraulic fluid along a variety of different hydraulic flow paths to control various mechanical functions. However, the electro-hydraulic multiplex control system still requires a hydraulic umbilical that is routed down through the drilling riser to enable operation of the subsea intervention equipment. The appropriate spooling/handling equipment also must be mounted on the surface rig to handle the umbilical, thus requiring substantial, valuable rig space.

SUMMARY

In general, the present invention provides a simplified technique for providing subsea hydraulic control. A subsea installation comprises one or more devices that are actuated hydraulically. A simple signal carrier, such as a wireline logging cable, can be routed down to the subsea installation. However, hydraulic fluid for controlling the one or more hydraulic devices in the subsea installation is delivered via an open water umbilical that extends to the subsea installation from a separate workover control system. This unique approach removes the need for a conventional bespoke electro-hydraulic umbilical routed down through a riser, which also removes the need for mounting associated spooling/handling equipment on the surface intervention facility.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
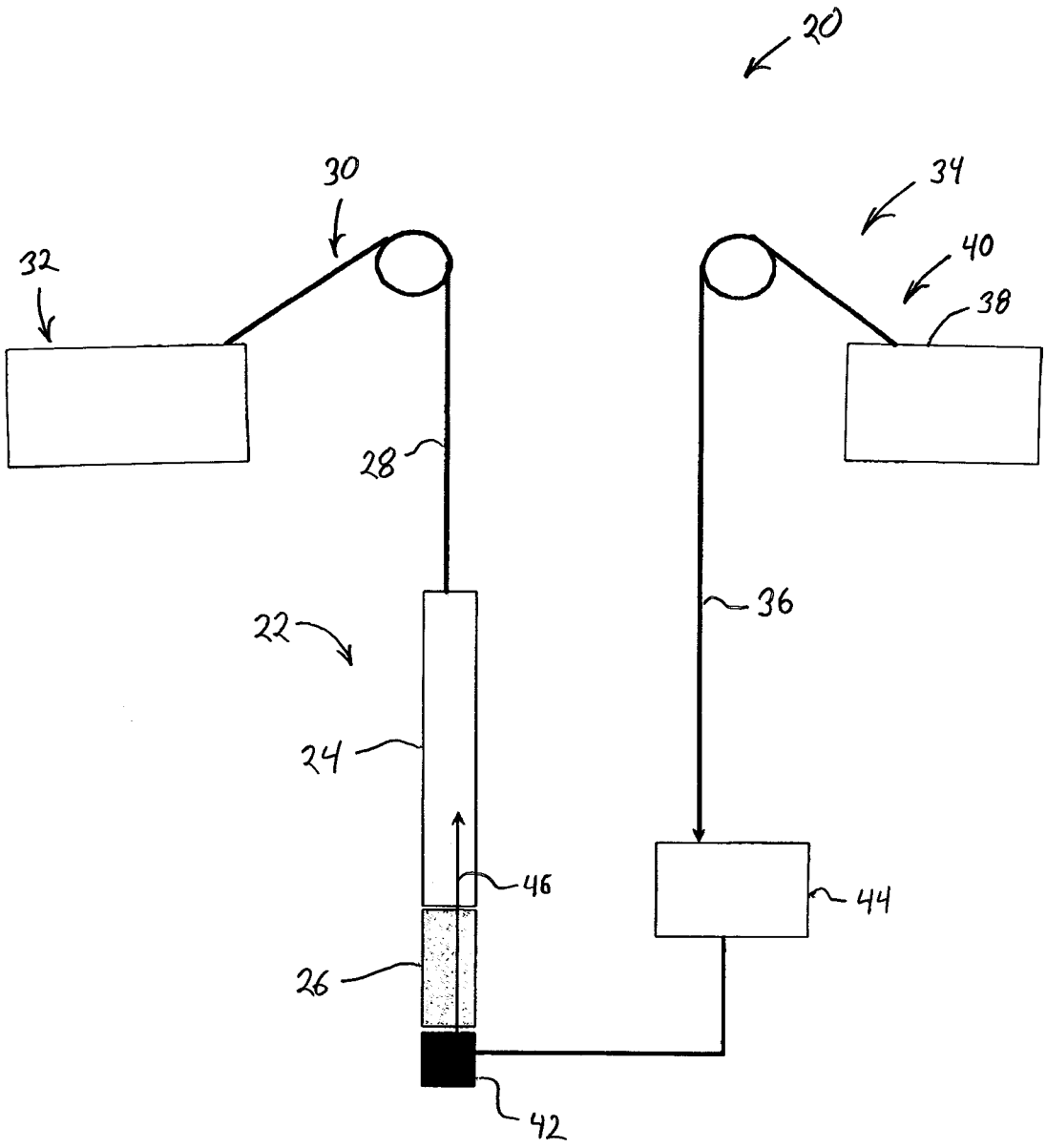
FIG. 1 is a schematic illustration of one example of a system for providing subsea hydraulic control, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a methodology and system for providing simplified subsea hydraulic control. According to one embodiment, a unique approach is provided for supplying pressurized hydraulic control fluids during a subsea intervention operation while minimizing the systems and components required on the intervention surface facility, e.g. intervention vessel. The approach can be used to operate hydraulically actuated devices at a subsea installation that may comprise, for example, a subsea test tree, a horizontal tubing hanger running tool, and/or other downhole equipment.

The present technique utilizes already existing sources of pressurized hydraulic fluid. According to one example, pressurized hydraulic fluid is supplied from an existing source in a client supplied workover control system. The supply of pressurized hydraulic fluid can be used to operate various devices in the subsea installation, such as devices in a subsea test tree, tubing hanger running tool, and other associated downhole equipment. Routing of the pressurized hydraulic fluid can be achieved with a subsea electro-hydraulic control system which is controlled by a simple signal carrier, such as an electrical cable, running inside the drilling riser from the surface intervention facility to the subsea installation. By way of example, the signal carrier may be part of a wireline logging cable.

The technique renders obsolete the need for a bespoke-hydraulic umbilical as used in conventional systems. The outside source of hydraulic fluid also enables replacement of the normal electrical power and control path that exist within a conventional electro-hydraulic umbilical with, for example, a standard wireline heptacable conductor, of the type which normally resides on a drilling rig. Replacement of the conventional electro-hydraulic umbilical with a hydraulic supply path already existing within a client supplied intervention workover control system umbilical greatly improves the speed of the operation. For example, the technique improves the speed at which a subsea test tree, tubing hanger running tool, and well completion can be run in hole. Consequently, expensive rig time is reduced.

The approach described herein further enables routing of a robust, small signal carrier, e.g. a wireline heptacable conductor, that does not use specialized clamps otherwise required for larger umbilicals. The simplified intervention approach further capitalizes on existing infrastructure within the client supplied subsea intervention workover control system and wellhead. Additionally, a typical intervention rig already comprises a permanent wireline logging cable and winch unit which can be used to deploy the signal carrier down along a riser. Because umbilical spooling/handling equipment is not required, the present technique conserves rig space while reducing costs associated with deployment of a bespoke umbilical. The reduction in equipment further reduces failure rates otherwise inherent with complex operating and servicing envelopes and procedures.

Referring generally to FIG. 1, an example of a system 20 for providing subsea hydraulic control is illustrated. In this embodiment, system 20 comprises a subsea installation 22 that may have a variety of components mounted, for example, at a seabed. In the specific example illustrated, subsea installation 22 comprises a subsea test tree 24 mounted over a tubing hanger running tool 26. Power and/or data signals are conveyed to and/or from the subsea installation 22 via a simple signal carrier 28. Signal carrier 28 may comprise an electrical conductor or other suitable signal carriers, such as fiber-optic lines. According to one embodiment, signal carrier 28 is part of a wireline logging cable 30 that is conveyed from a surface location via, for example, a wireline winch system 32. The wireline logging cable 30 may comprise a rugged wireline heptacable conductor of the type that often already resides on a drilling rig.

The signal carrier 28 may be run from a surface facility without the hydraulic umbilical or other hydraulic equipment normally used to operate hydraulic components of subsea installation 22. Instead, a pressurized hydraulic fluid is obtained from a client supplied workover control system 34, such as an intervention work over control system used in performing a variety of subsea intervention operations. The work over control system 34 comprises an open water umbilical 36 that is routed down to subsea installation 22 through the open water to provide a hydraulic fluid supply for operating components on subsea installation 22.

The umbilical 36 may be connected to an umbilical winch 38 of a workover control system unit 40 positioned on a separate surface facility. Depending on the subsea installation 22, open water umbilical 36 comprises a plurality of hydraulic tubes or hoses used to operate the one or more hydraulic devices within subsea installation 22.

As illustrated, umbilical 36 is routed down to an electro-hydraulic control system 42 of subsea installation 22. The umbilical 36 may be routed to electro-hydraulic control system 42 through a production control system pod 44 of workover control system 34. In this embodiment, electro-hydraulic control system 42 also is connected to signal carrier 28 and is positioned beneath tubing hanger running tool 26 and subsea test tree 24. The electro-hydraulic control system 42 may be selectively controlled/actuated via appropriate signals sent through signal carrier 28. As a result, hydraulic control fluid from workover control system 34 is selectively used and routed up through subsea installation 22 to desired hydraulically actuatable devices, as represented by arrow 46.

Figure 2:
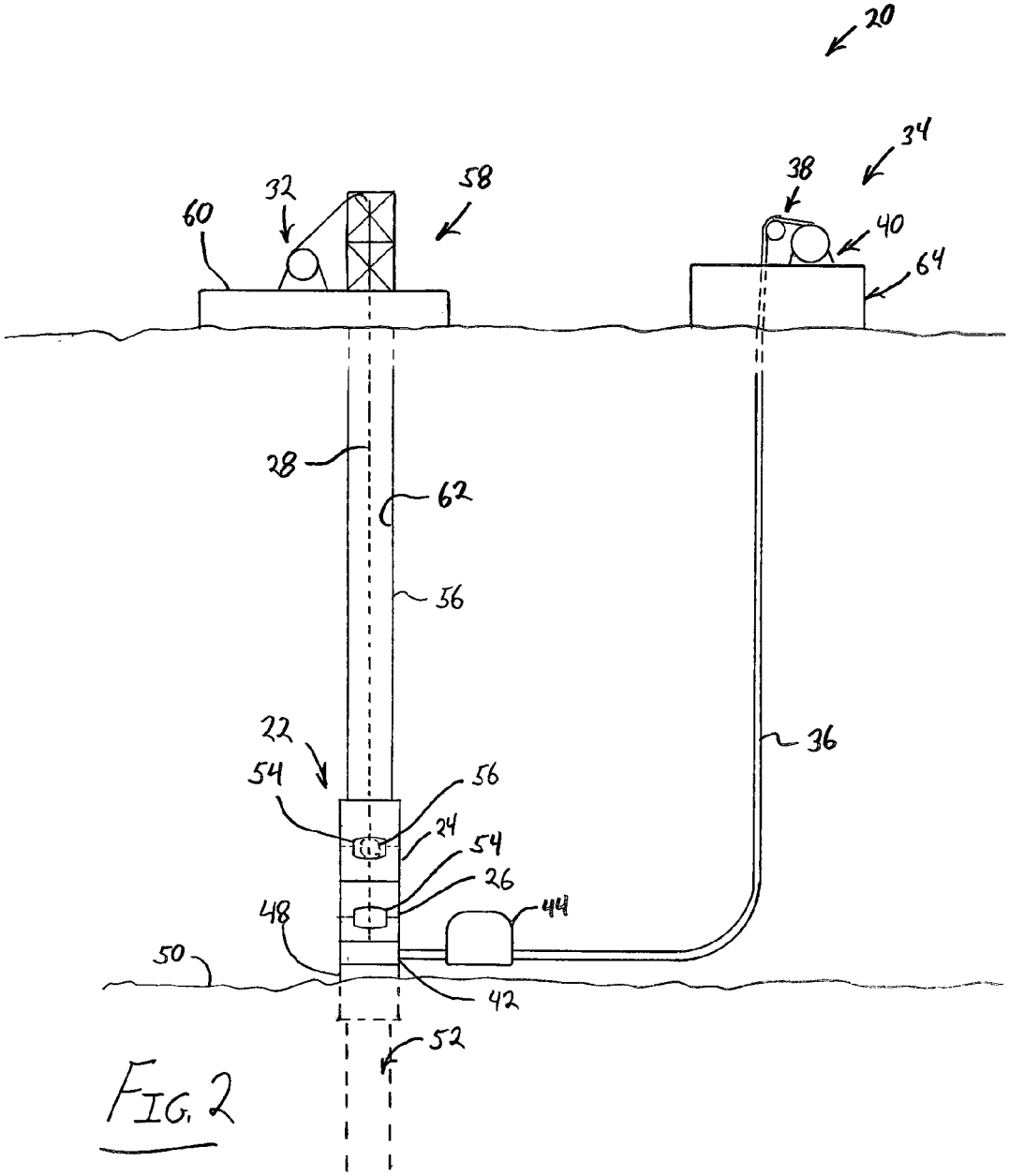
FIG. 2 is a more detailed example of one embodiment of the system illustrated in FIG. 1, according to an embodiment of the present invention.

Referring generally to FIG. 2, one embodiment of system 20 is illustrated in greater detail. In this embodiment, subsea installation 22 is mounted over a wellhead 48 positioned at a seafloor 50 and over a well 52. The subsea installation 22 may again comprise a variety of components, such as subsea test tree 24 and tubing hanger running tool 26. Each of these components may comprise one or more hydraulically actuatable devices 54, e.g. valves, that are actuated via hydraulic fluid from the client supplied workover control system 34. By way of example, the hydraulically actuatable devices 54 may comprise a ball valve 56 positioned in subsea test tree 24 to control the flow of fluids through the subsea test tree.

In the embodiment illustrated in FIG. 2, a tubing 56 is connected between subsea installation 22 and a surface facility 58 which may comprise a surface intervention vessel 60. By way of example, tubing 56 may comprise a riser or other tubing that protects the movement of equipment between surface facility 58 and subsea installation 22. The signal carrier 28 is routed between surface facility 58 and subsea installation 22 along the tubing 56, e.g. riser, and may be routed along an interior 62 of the tubing 56.

In this example, hydraulic control fluid is again supplied through open water umbilical 36 of the client supplied workover control system 34. For example, the umbilical 36 may be connected to workover control system unit 40 mounted on a workover surface facility 64 that is separate from the intervention surface facility 58. The umbilical 36 is routed from workover surface facility 64 down through the open sea water to electro-hydraulic control system 42. Power and/or signal communication for subsea installation 22 is directed from surface facility 58 via signal carrier 28. However, the hydraulic fluid and equipment to handle the supply of hydraulic fluid for actuating devices 54 of subsea installation 22 is supplied from a separate system, such as the client supplied workover control system 34. This approach greatly simplifies the equipment required on surface intervention vessel 60, or other surface intervention facility, while improving the efficiency of the intervention operation.

As described, system 20 enables a methodology which simplifies intervention related operations on subsea wells by utilizing an outside source for pressurized hydraulic fluid to control the subsea installation components, e.g. subsea test trees, horizontal tubing hanger running tools, and many types of hydraulically controlled downhole equipment. The types of hydraulically actuated devices within the subsea installation and the actual components of the subsea installation may vary from one well operation to another. Additionally, many types of electro-hydraulic control systems may be utilized to direct hydraulic fluid to the appropriate hydraulic devices associated with the subsea installation.

The surface intervention vessel 60, or other surface intervention facility, can be designed to accommodate a variety of subsea intervention operations and other well related operations. Many types of equipment, including many types of risers and other types of tubing can be used in cooperation with a variety of permanent and temporary subsea equipment. In many of these operations, the outsourced supply of hydraulic fluid may be obtained from various workover control systems through many types of umbilicals. Regardless, the outsourced supply of hydraulic fluid for actuating components within the subsea equipment greatly increases the efficiency of the subsea operation.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for providing subsea hydraulic control, comprising:

a subsea test tree;

a tubing hanger running tool;

a plurality of hydraulically actuatable devices mounted in at least one of the subsea test tree or the tubing hanger running tool;

a wireline conductor extending down through a drilling riser to an electro-hydraulic control system; and a separate workover control system, the separate workover control system having an open water umbilical that extends from a surface location to the electro-hydraulic control system to provide hydraulic fluid for controlling the plurality of hydraulically actuatable devices.

2. The system as recited in claim 1, wherein the plurality of hydraulically actuatable devices comprises a ball valve in the subsea test tree.

3. The system as recited in claim 1, wherein the wireline conductor is part of a wireline logging cable.

4. The system as recited in claim 3, wherein the wireline logging cable is deployed by a wireline winch located on a surface intervention facility.

5. The system as recited in claim 4, wherein the separate workover control system comprises an umbilical winch positioned at a separate surface location.

6. A method for providing subsea hydraulic control, comprising:

positioning a subsea test tree and a tubing hanger running tool at a subsea location;

locating a riser above the subsea test tree and the tubing hanger running tool;

routing a signal carrier along the riser to the subsea test tree and the tubing hanger running tool;

routing an open water umbilical from a surface location to an electro-hydraulic control system coupled to the subsea test tree and the tubing hanger running tool; and supplying pressurized hydraulic control fluid to at least one of the subsea test tree and the tubing hanger running tool from an existing hydraulic fluid system of a workover control system, wherein supplying comprises supplying pressurized hydraulic control fluid through the open water umbilical of the workover control system.

7. The method as recited in claim 6, wherein locating comprises locating the riser through the water between the subsea test tree and a surface intervention facility.

8. The method as recited in claim 6, wherein routing comprises routing the signal carrier within the riser.

9. The method as recited in claim 6, wherein routing comprises routing the signal carrier in the form of a wireline logging cable.

10. The method as recited in claim 6, further comprising utilizing the open water umbilical and the electro-hydraulic control system to control a plurality of hydraulically actuatable devices in the subsea test tree and the tubing hanger running tool.

11. The method as recited in claim 10, wherein utilizing comprises controlling a ball valve in the subsea test tree.

12. A system, comprising:

a subsea installation having a hydraulically actuatable device;

a subsea test tree of the subsea installation;

a tubing extending upward from the subsea installation;

a signal carrier extending along the tubing to the subsea installation; and an open water umbilical of a separate workover control system extending to the subsea installation to enable hydraulic actuation of the hydraulically actuatable device, wherein the subsea installation comprises an electro-hydraulic control system to which the signal carrier and the open water umbilical are connected.

13. The system as recited in claim 12, wherein the subsea installation comprises a tubing hanger running tool.

14. The system as recited in claim 12, wherein the tubing comprises a riser extending upwardly to a surface location.

15. The system as recited in claim 12, wherein the signal carrier comprises an electrical conductor.

16. The system as recited in claim 12, wherein the signal carrier is a wireline logging cable.

17. The system as recited in claim 12, wherein the hydraulically actuatable device comprises a valve.

* * * * *